United States Patent [19]

Funkhouser, Jr.

[11] Patent Number: 4,832,526

[45] Date of Patent: May 23, 1989

[54] UNDERGROUND WATERING SYSTEM

[75] Inventor: Richard N. Funkhouser, Jr., Hagerstown, Md.

[73] Assignee: Har-Tru Corporation, Hagerstown, Md.

[21] Appl. No.: 125,863

[22] Filed: Nov. 27, 1987

[51] Int. Cl.[4] ..... E02B 11/00; E02B 13/00

[52] U.S. Cl. ..... 405/43; 405/36; 405/45; 405/38

[58] Field of Search ..... 405/36, 37, 38, 39, 405/43, 270, 45, 258

[56] References Cited

U.S. PATENT DOCUMENTS

| | | | |
|---|---|---|---|
| 3,307,360 | 3/1967 | Bailly | 405/38 |
| 3,479,825 | 11/1969 | Hellstrom | 405/38 |
| 3,849,991 | 11/1974 | Niederwemmer | 405/38 |
| 3,908,385 | 9/1975 | Daniels et al. | 405/37 |
| 4,117,685 | 10/1978 | Skaife | 405/38 X |
| 4,462,184 | 7/1984 | Cunningham | 405/37 X |
| 4,576,511 | 3/1986 | Vidal | 405/38 X |
| 4,624,604 | 11/1986 | Wagner et al. | 405/128 |

*Primary Examiner*—Dennis L. Taylor

*Attorney, Agent, or Firm*—David S. Schrivener; William L. Gates

[57] ABSTRACT

An underground watering system for an athletic facility such as a tennis court, comprising a plurality of select equally spaced shallow water reservoir trenches having rounded surfaces over which is applied a waterproof liner. A water distribution pipe is located on the lining at the bottom of such trench and extends the entire length thereof. The trenches are filled with fine stone aggregate over which is laid a water permeable fabric which covers the whole area to be watered. A relatively coarse layer of aggregate is placed over the fabric followed by an upper layer of relatively fine aggregate. A layer of playing surface material overlays the fine aggregate layer. Water supplied to the trenches via the distribution pipes will saturate the permeable fabric and will be drawn up to the playing surface by capillary action.

2 Claims, 1 Drawing Sheet

WATER SUPPLY
CONTROL BOX

UNDERGROUND WATERING SYSTEM

BACKGROUND OF THE INVENTION

This invention relates to an underground watering system for supplying moisture to a surface layer and more particularly to such a system for watering the surface of an athletic facility, particularly a tennis court.

Apparatus located underground for supplying water to the surface of a defined area is well known and takes many forms. Such systems are utilized not only in agriculture for the irrigation of crops, but also in the sports and recreational fields. Such applications include underground watering systems for football and baseball fields, golf courses and tennis courts, particularly tennis courts employing clay or fast drying playing surfaces.

A typical example of an underground watering system for a tennis court is disclosed in U.S. Pat. No. 4,576,511 issued to S. P. Vidal, Jr. on Mar. 18, 1986. The system disclosed in this patent includes an underground structure formed of rock and cinders to provide an artificial water table at a selected distance below the ground. The watering system includes a water tight membrane that lines a basin evacuated in the earth over the complete area of the tennis court to be watered. A ballast layer which is extremely permeable by water and being of generally uniform size rock is laid on top of the water tight membrane. The ballast layer is next covered by a permeable membrane such as cloth. The permeable membrane ss in turn covered by an upper layer of finely divided particles such as crushed volcanic ash or cinders which are prevented from penetrating the ballast layer by the permeable membrane. This upper fine layer permits water to diffuse through it to the surface by capillary action. The fine layer is topped by a finish layer which comprises the playing surface of the tennis court. Water is inserted in the ballast layer, causing the water table in it to rise to and above the permeable membrane. The amount of water supplied to the playing surface is adjusted by float valve means mounted in an adjacent reservoir communicating with the space occupied by the ballast layer. The float valve means is responsive to the water level in the reservoir to admit water thereto when the water level therein falls below a preset level.

It is an object of the present invention, therefore, to provide an improvement in underground watering systems.

It is another object of the invention to provide an improvement in underground watering systems for supplying water to the surface of a defined area.

It is yet another object of the invention to provide an improvement in underground watering systems used in connection with athletic facilities.

Still another object of the invention is to provide an improvement in underground watering systems for supplying moisture to the playing surface of an athletic field.

Still a further object of the invention is to provide an improvement in underground watering systems for supplying moisture to the playing surface of a tennis court.

SUMMARY

Briefly, the foregoing and other objects of the invention are provided by an underground watering system, particularly for a tennis court, comprised of a plurality of substantially equally spaced parallel trenches formed in the ground of the space to be watered. The trenches extend substantially the entire length of the tennis court, for example. Each of the trenches have a rounded or ovular bottom surface over which is laid a liner of waterproof material. Water distribution means comprising a distribution pipe is located on the liner at the bottom of each trench and extends substantially the entire length thereof. The trenches are filled with stone aggregate over which is laid a water permeable fabric which additionally covers the entire area of the space to be watered. A relatively coarse layer of aggregate is placed over the fabric followed by an upper layer of relatively fine aggregate. A layer of playing surface material, such as clay, or other fast drying material overlays the fine aggregate layer. When water is supplied to the trenches via the distribution pipes, capillary action saturates the permeable fabric and moisture is drawn up to the playing surface.

BRIEF DESCRIPTION OF THE DRAWING

The objects of the present invention and the attendant advantages thereof will become readily apparent by reference to the following drawing wherein like reference numerals refer to like components, and wherein.

DETAILED DESCRIPTION OF THE INVENTION

Figures 1, 2, 3:
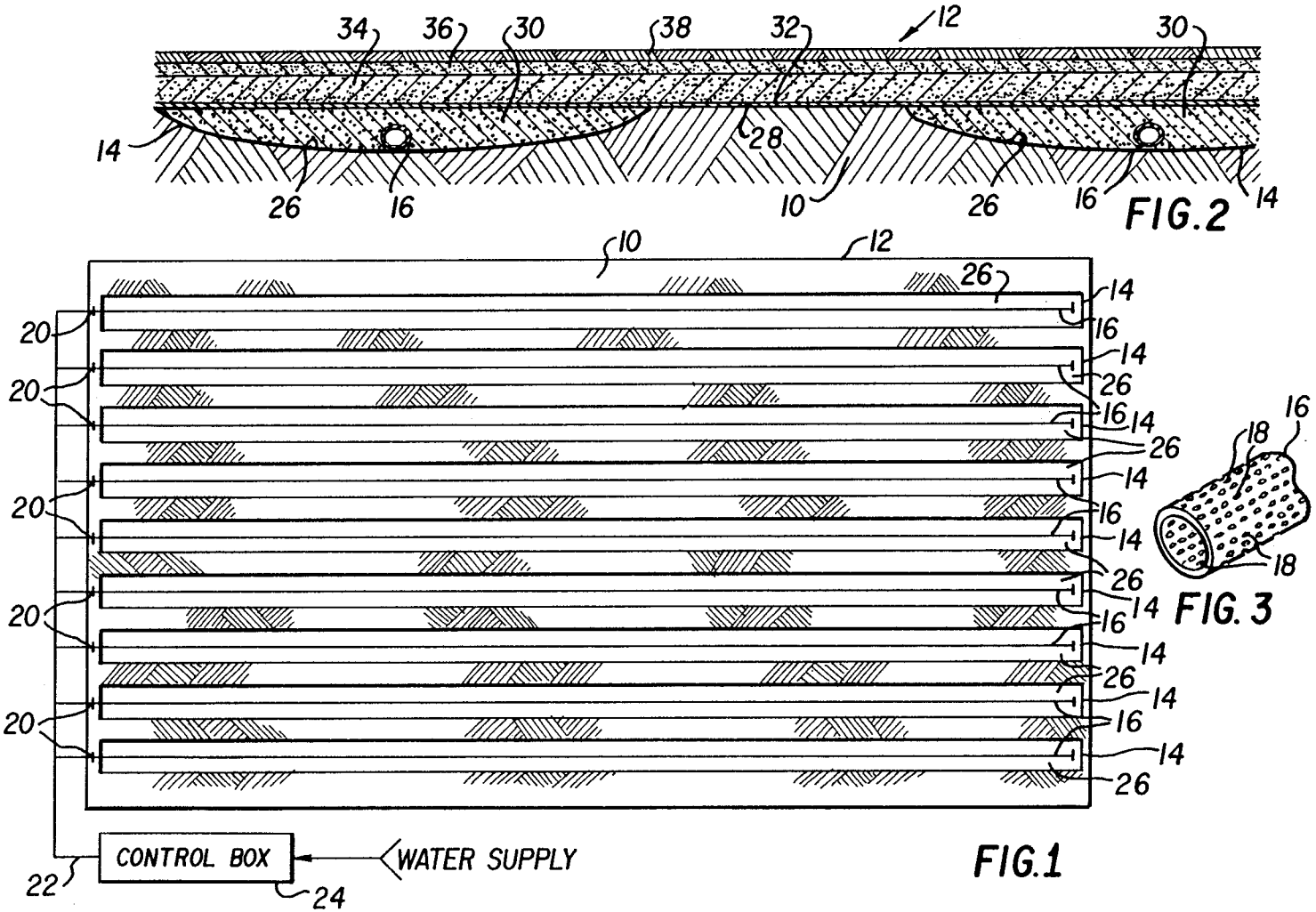
FIG. 1 is a schematic planar representation of the base of a tennis court and illustrating the arrangement of a plurality of parallel trenches including water distribution means in accordance with the preferred embodiment of the subject invention.
FIG. 2 is a partial schematic cross sectional view of the preferred embodiment of a tennis court constructed in accordance with the subject invention.
FIG. 3 is a partial perspective view illustrative of a water distribution pipe located in the parallel trenches of FIG. 2.

Referring now to the drawings, reference numeral 10 denotes the base material, such as the ground, of a predefined area 12 to be watered y the subject invention. The predefined area 12 preferably comprises the 60′×120′ dimensions of a tennis court, although it is not meant to be limited to such because, when desirable, the area may consist of any plot of ground, including, for example, an athletic field such as a football field or baseball diamond. It may also be utilized in connection with the greens of a golf course.

Referring now to FIG. 1, the case 10 of the tennis court 12 includes a plurality of equally spaced trenches 14 which are of equal length (120′), width (4′) and depth (5″) which extend the entire length of the tennis court 12. It should be noted, however, that when desirable the trenches 14 could be aligned tranversely relative to the length dimension of the tennis court.

In each of the plurality of trenches 14 there is located a respective elongated water distribution pipe 16. As shown in FIG. 3, the distribution pipes 16 include a plurality of small holes 18 or other type of relatively small openings such as slits so that water within the pipe can leak or seep therefrom to the surrounding region. One end of the distribution pipes terminates in respective couplings 20, which in turn couple to a conventional water feed pipe plumbing arrangement 22 which connects to a control box 24 containing manual or automatically controlled valves, not shown, coupled to a water supply.

Referring now to FIG. 2, which discloses a partial transverse cross section of the space to be watered, e.g. the tennis court 12 shown in FIG. 1, each trench 14 includes a relatively shallow concave surface which is generally ovular in configuration. Within the cavity of each of the trenches 14, there is located a waterproof liner 26 which conforms to the shape of the trench cavity and which extends up to the top surface 28 of the base material 10. Further as shown in FIG. 2 the distribution pipe member 16 is generally centrally located within the trench 14 on top of the liner 26. With the distribution pipe 16 in place, each of the trenches is filled with porous material such as stone aggregate 30 of a type which can support a wicking action so that water supplied thereto from the distribution pipe 16 can disperse therethrough through capillary action. With the aggregate 30 leveled off at the base or ground level 28, a permeable fabric material 32 is laid over the entire surface area including the upper surface of the aggregate 30 and the base material 28. With the fabric 32 in place, moisture supplied thereto from the channel 14 will distribute substantially evenly over the entire area covered by the fabric 32. Two intermediate layers of stone aggregate 34 and 36 are evenly distributed over the permeable fabric 32 with the depths of the lower aggregate being relatively greater than the upper layer 36. Furthermore, the aggregate layer 34 can be of a relatively coarser type than that of the upper layer 36, however, both layers are selected to support capillary action of moisture from the permeable fabric 3 upward to an outermost playing surface layer 38 which is comprised of, for example, clay or other fast drying tennis court surface material. When desirable, however, the uppermost layer 38 may be comprised of grass or other type of playing surface.

Thus what has been shown and described is a relatively simple yet effective means of supplying moisture to a playing surface, particularly a tennis court. As noted above, although this invention has been described primarily as it pertains to a means for supplying moisture to the surface of a tennis court, it must be remembered that such a system could equally well be used for any other desired purpose where underground water distribution to a surface is required.

Having thus shown and described what is at present considered to be the preferred embodiment of the invention, it should be noted that the same has been made by way of illustration and not limitation. Accordingly, all modifications, alterations and changes coming within the spirit and scope of the invention are herein meant to be included.

I claim:

1. An underground system for supplying moisture uniformly to porous material over a predetermined rectangular area, comprising:

an area of base material;

a plurality of relatively flat, elliptical, parallel equispaced trenches having a curved bottom surface formed in the outer surface of said base material;

waterproof liner means located in each of said trenches, being coextensive therewith and conforming to the dimensions of said trenches, and extending to the surface of said base material;

means located within said trenches on top of said liner means for evenly distributing water into said trenches;

a first layer of porous material deposited in said trenches over said liner means and said water distributing means to the surface of said base material by capillary action;

permeable fabric means located over said first layer of porous material and the surface of said base material and extending over said predetermined area;

first and second intermediate layers of porous material deposited over said permeable fabric means, said first and second intermediate layers being of a type to support capillary action therethrough, said first intermediate layer being contiguous to said fabric means; and an outer layer constituting said porous material to be supplied moisture deposited over said second intermediate layer of porous material.

2. The system as defined by claim 1 wherein said predetermined area comprises a tennis court, and wherein said layers of porous material comprise layers of aggregate and said outer layer of porous material comprises the tennis court playing surface.

* * * * *